US008378949B2

(12) United States Patent
Tu et al.

(10) Patent No.: US 8,378,949 B2
(45) Date of Patent: Feb. 19, 2013

(54) DRIVING APPARATUS FOR LIQUID CRYSTAL DISPLAY

(75) Inventors: Ming-Hung Tu, Taipei County (TW); Sheng-Kai Hsu, Changhua County (TW); Yung-Tse Cheng, Hsinchu (TW); Chih-Sung Wang, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 668 days.

(21) Appl. No.: 12/248,044

(22) Filed: Oct. 9, 2008

(65) Prior Publication Data

US 2010/0045587 A1 Feb. 25, 2010

(30) Foreign Application Priority Data

Aug. 19, 2008 (TW) ..... 97131636 A

(51) Int. Cl.
*G09G 3/36* (2006.01)

(52) U.S. Cl. ..... 345/98

(58) Field of Classification Search ..... 345/87, 345/98, 99, 100

See application file for complete search history.

(56) References Cited

U.S. PATENT DOCUMENTS

| | | | | |
|---|---|---|---|---|
| 6,661,413 | B2 | 12/2003 | Sakaguchi | |
| 7,046,223 | B2 | 5/2006 | Hashimoto | |
| 7,193,623 | B2 | 3/2007 | Moon | |
| 7,224,353 | B2 | 5/2007 | Song et al. | |
| 7,289,095 | B2 * | 10/2007 | Park et al. | 345/98 |
| 7,477,227 | B2 | 1/2009 | Hashimoto | |
| 2002/0093475 | A1 * | 7/2002 | Hashimoto | 345/87 |
| 2003/0001808 | A1 * | 1/2003 | Sakuma et al. | 345/87 |
| 2003/0030604 | A1 * | 2/2003 | Moon et al. | 345/87 |
| 2003/0122761 | A1 * | 7/2003 | Hong | 345/89 |
| 2005/0012705 | A1 * | 1/2005 | Akahori | 345/99 |
| 2005/0168429 | A1 * | 8/2005 | Chou | 345/100 |
| 2006/0007382 | A1 * | 1/2006 | Sano | 349/150 |
| 2006/0061532 | A1 | 3/2006 | Hashimoto | |
| 2007/0273625 | A1 * | 11/2007 | Cheng | 345/87 |
| 2009/0040158 | A1 * | 2/2009 | Chuang | 345/89 |

FOREIGN PATENT DOCUMENTS

TW 571278 1/2004

OTHER PUBLICATIONS

"Office Action of Taiwan counterpart application" issued on Nov. 23, 2012, p1-p8, in which TW571278 was cited.

* cited by examiner

*Primary Examiner* — Chanh Nguyen
*Assistant Examiner* — Pegeman Karimi
(74) *Attorney, Agent, or Firm* — Jianq Chyun IP Office

(57) ABSTRACT

A driving apparatus for a liquid crystal display (LCD) is provided. The driving apparatus includes a plurality of data driving ICs and a control board. The data driving ICs are used for receiving and transmitting a clock signal, a plurality of data signals and a first reference voltage from the 1st data driving IC to the last data driving IC in series. The control board is used for providing the clock signal, the data signals and the first reference voltage, and changing the first reference voltage received by each data driving IC according to a variation of the clock signal and the data signals transmitted between the data driving ICs, so that the operation frequency of the data driving ICs is unrestricted.

14 Claims, 4 Drawing Sheets

DRIVING APPARATUS FOR LIQUID CRYSTAL DISPLAY

CROSS-REFERENCE TO RELATED APPLICATION

This application claims the priority benefit of Taiwan application serial no. 97131636, filed on Aug. 19, 2008. The entirety of the above-mentioned patent application is hereby incorporated by reference herein and made a part of this specification.

BACKGROUND OF THE INVENTION

1. Field of the Invention

The present invention relates to a flat display technology, and more particularly, to a driving apparatus for a liquid crystal display (LCD).

2. Description of the Related Art

With the rapid and staggering progress of science and technologies, since the resolution of the liquid crystal display (LCD) is gradually increased, so that the operation frequency of the data driving integrated circuits (ICs) of the LCD should also be speeded up. In general, for speeding up the operation frequency of the data driving ICs, the data driving ICs would be coupled in series, and collocated with the stub series terminated logic (SSTL) interface, which should have a reference voltage in operation, to transmit the clock signal and the data signals provided by the timing controller. However, since the reference voltage provided to each data driving IC is identical, moreover, the clock signal and the data signals transmitted between the data driving ICs would be caused attenuation so that the difference between the clock signal and the reference voltage, and the difference between the data signals and the reference voltage would be changed. Consequently, the operation frequency of each data driving IC would be restricted.

SUMMARY OF THE INVENTION

The present invention is directed to a driving apparatus, for a liquid crystal display (LCD), which achieves that the operation frequency of the data driving ICs is unrestricted.

The present invention provides a driving apparatus for an LCD. The driving apparatus includes a plurality of data driving integrated circuits (ICs) and a control board. The data driving ICs are used for receiving and transmitting a clock signal, a plurality of data signals and a first reference voltage from the 1$^{st}$ data driving IC to the last data driving IC in series; and the control board is used for providing the clock signal, the data signals and the first reference voltage. The control board changes the first reference voltage received by each of the data driving ICs according to a variation of the clock signal and the data signals transmitted between the data driving ICs, so that the operation frequency of the data driving ICs is unrestricted.

The present invention also provides a driving apparatus for an LCD. 20 The driving apparatus includes a plurality of data driving ICs and a control board. The data driving ICs are used for receiving and transmitting a clock signal, a plurality of data signals, a first reference voltage and a second reference voltage from the 1$^{st}$ data driving IC to the last data driving IC in series. The control board is used for providing the clock signal, the data signals, the first reference voltage and the second reference voltage. The control board determines each of the data driving ICs to receive the first reference voltage or the second reference voltage according to a variation of the clock signal and the data signals transmitted between the data driving ICs, so that the operation frequency of the data driving ICs is unrestricted.

The driving apparatus of the LCD submitted by the present invention changes the reference voltage provided to each data driving IC by detecting the variation of the clock signal and the data signals transmitted between the data driving ICs through the control board. Accordingly, each of the data driving ICs will receive an appropriate reference voltage, so that the operation frequency of each of the data driving ICs would not be restricted by the attenuation of the clock signal and the data signals.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
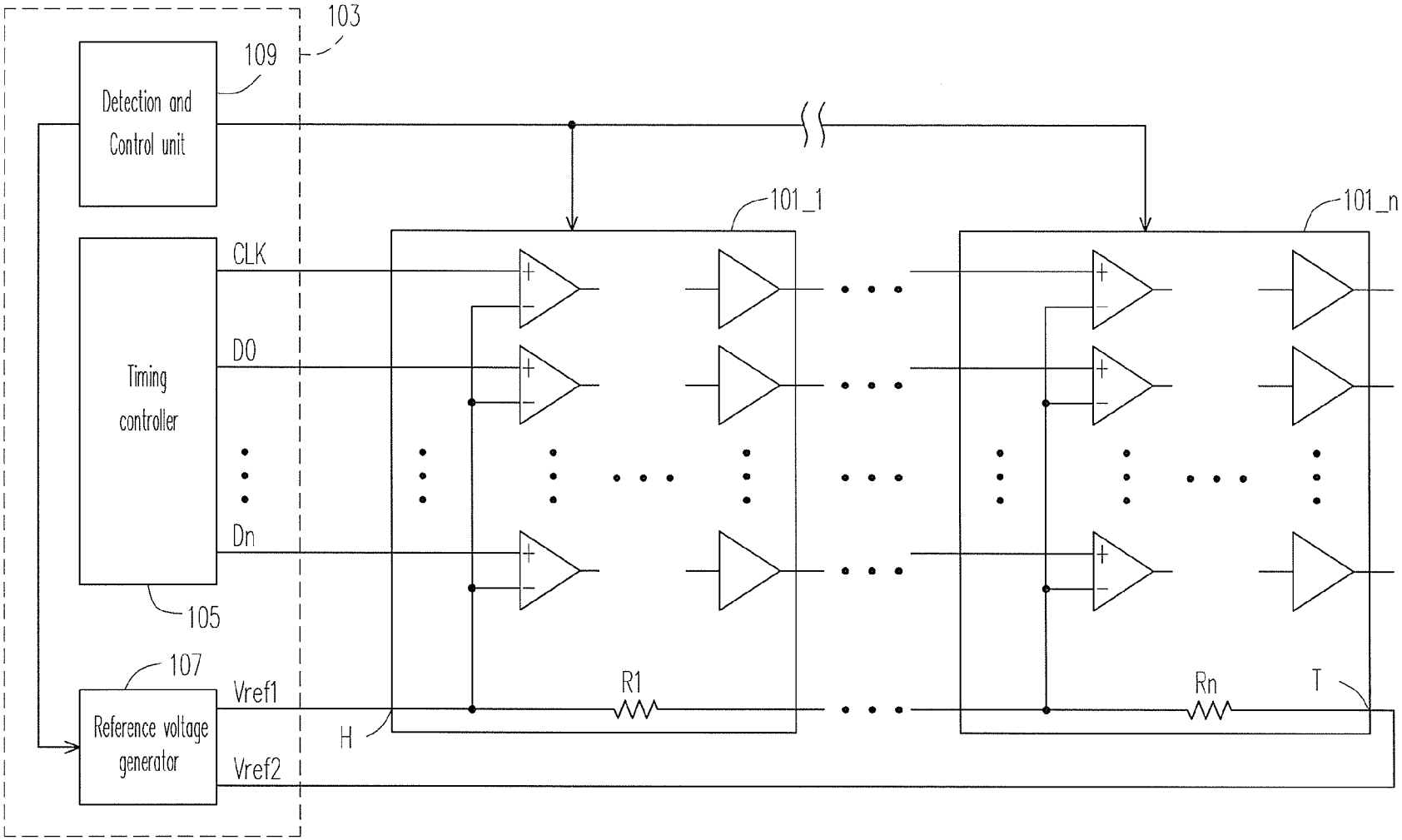
FIG. 1 is a block diagram showing a driving apparatus for a liquid crystal display according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The present invention wants to achieve at least the purpose of the operation frequency of each of the data driving ICs in the LCD would not be restricted by the attenuation of the clock signal and the data signals.

FIG. 1 is a block diagram showing a driving apparatus 100 for a liquid crystal display (LCD) according to an embodiment of the present invention. Referring to FIG. 1, the driving apparatus 100 includes a plurality of data driving ICs 101_1~101_n and a control board 103, where n is a positive integer. The data driving ICs are used for receiving and transmitting a clock signal CLK, a plurality of data signals D0~Dn and a first reference voltage Vref1 from the 1$^{st}$ data driving IC 101_1 to the last data driving IC 101_n in series. The control board 103 is used for providing the clock signal CLK, the data signals D0~Dn and the first reference voltage Vref1, wherein the control board 103 may be formed on an external print circuit board (PCB) or formed on a substrate on which multiple pixels are disposed.

Herein, one person having ordinary skill in the art should know that the data driving ICs 101_1·101_n would be collocated with the SSTL interface, which should have a reference voltage in operation, to transmit the clock signal CLK and the data signals D0~Dn provided by the control board 103. In addition, the data driving ICs 101_1·101_n of the present embodiment can be directly disposed on the glass substrate of the LCD panel (not shown).

In the present embodiment, the control board 103 changes the first reference voltage Vref1 received by each of the data driving ICs 101_1~101_n according to a variation of the clock signal CLK and the data signals D0~Dn transmitted between the data driving ICs 101_1~101_n, so that the operation frequency of the data driving ICs 101_1~101_n is unrestricted.

To be specific, the control board 103 includes a timing controller 105, a reference voltage generator 107 and a detection and control unit 109. The timing controller 105 is used for generating the clock signal CLK and the data signals D0~Dn. The reference voltage generator 107 is used for providing the first reference voltage Vref1 to a head terminal H of a loop formed by transmitting the first reference voltage Vref1 between the data driving ICs 101_1~101_n, and providing a second reference voltage Vref2 to an end terminal T of the loop formed by transmitting the first reference voltage Vref1 between the data driving ICs 101_1~101_n. The detection and control unit 109 is used for detecting the variation of the clock signal CLK and the data signals D0~Dn transmitted between the data driving ICs 101_1~101_n, and controlling the reference voltage generator 107 accordingly, so as to adjust the first reference voltage Vref1 received by each of the data driving ICs 101_1~101_n.

In the present embodiment, the detection and control unit 109 detecting the variation of the clock signal CLK and the data signals D0~Dn transmitted between the data driving ICs 101_1~101_n may detect an attenuation status of the clock signal CLK and the data signals D0~Dn transmitted between the data driving ICs 101_1~101_n, but not limited thereto.

Figure 2:
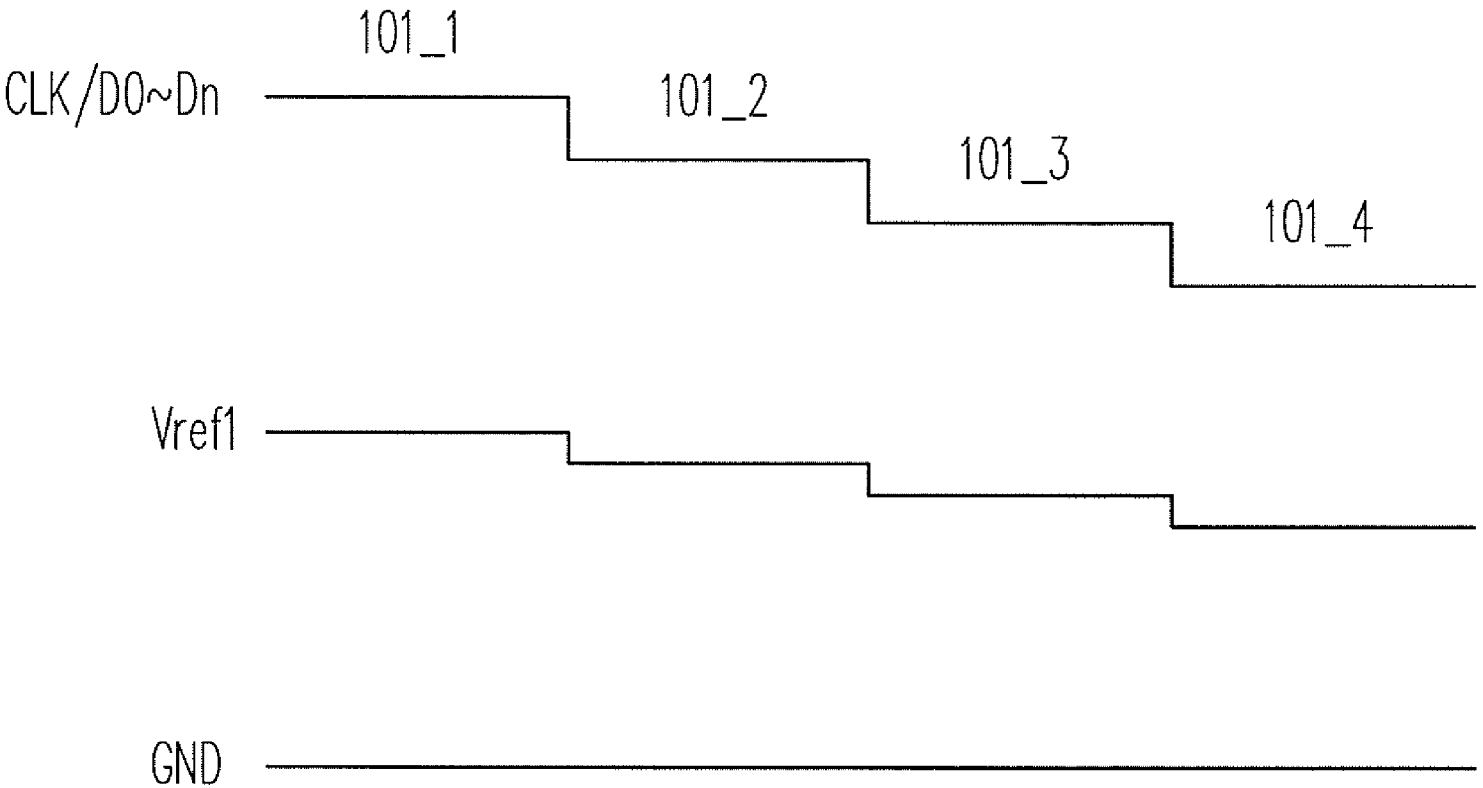
FIG. 2 is a diagram showing a first reference voltage received by each of the data driving ICs according to an embodiment of the present invention.

In addition, since the inner resistance of each of the data driving ICs 101_1~101_n is substantially identical, so that the detection and control unit 109 would be correspondingly changed the reference voltages Vref1 or Vref2 according to the attenuation of the clock signal CLK and the data signals D0~Dn transmitted between the data driving ICs 101_1~101_n. Accordingly, the attenuation status of the first reference voltage Vref1 provided by the reference voltage generator 107 will be identical to the attenuation status of the clock signal CLK and the data signals D0~Dn transmitted between the data driving ICs 101_1~101_n (as shown in FIG. 2), so that each of the data driving ICs 101_1~101_n would receive the appropriate first reference voltage Vref1 correspondingly.

In the present embodiment, the detection and control unit 109 would detect the variation (i.e. the attenuation status) of the clock signal CLK and the data signals D0~Dn transmitted between the data driving ICs 101_1~101_n to adjust the second reference voltage Vref2 provided by the reference voltage generator 107 and then changes the first reference voltage Vref1 received by each of the data driving ICs 101_1~101_n. Accordingly, each of the data driving ICs 101_1~101_n would receive the appropriate first reference voltage Vref1, so that the operation frequency of each of the data driving ICs 101_1~101_n would not be restricted by the attenuation of the clock signal CLK and the data signals D0~Dn.

Figure 3:
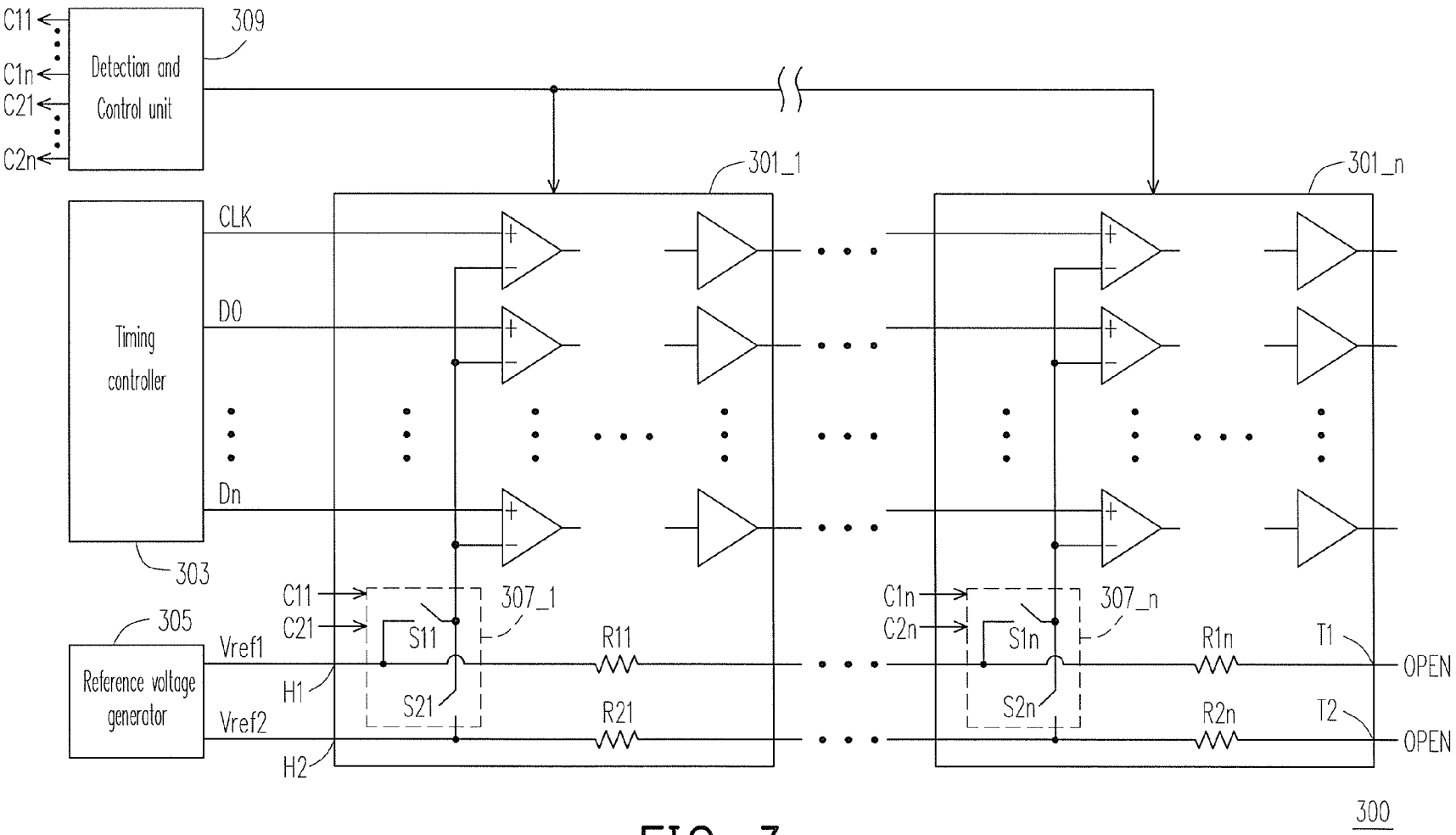
FIG. 3 is a block diagram showing a driving apparatus for a liquid crystal display according to another embodiment of the present invention.

FIG. 3 is a block diagram showing a driving apparatus 300 for a liquid crystal display (LCD) according to another embodiment of the present invention. Referring to FIG. 3, the driving apparatus 300 includes a plurality of data driving ICs 301_1~301_n and a control board which is composed of a timing controller 303, a reference voltage generator 305, a plurality of selection units 307_1~307_n and a detection and control unit 309, wherein n is a positive integer, and the control board may be formed on an external print circuit board (PCB) or formed on a substrate on which multiple pixels are disposed.

The data driving ICs 301_1~301_n are used for receiving and transmitting a clock signal CLK, a plurality of data signals D0~Dn, a first reference voltage Vref1 and a second reference voltage Vref2 from the $1^{st}$ data driving IC 301_1 to the last data driving IC 301_n in series. The control board is used for providing the clock signal CLK, the data signals D0~Dn, the first reference voltage Vref1 and the second reference voltage Vref2.

Herein, one person having ordinary skill in the art should know that the data driving ICs 301_1~301_n would be collocated with the SSTL interface, which should have a reference voltage in operation, to transmit the clock signal CLK and the data signals D0~Dn provided by the control board. In addition, the data driving ICs 301_1~301_n of the present embodiment can be directly disposed on the glass substrate of the LCD panel (not shown).

In the present embodiment, the control board determines each of the data driving ICs 301_1~301_n to receive the first reference voltage Vref1 or the second reference voltage Vref2 (the first and the second reference voltages Vref1 and Vref2 can be determined by practical design requirement) according to a variation of the clock signal CLK and the data signals D0~Dn transmitted between the data driving ICs 301_1~301_n, so that the operation frequency of the data driving ICs 301_1~301_n is unrestricted.

From the above, the control board is composed of the timing controller 303, the reference voltage generator 305, the selection units 307_1~307_n and the detection and control unit 309. The timing controller 305 is used for generating the clock signal CLK and the data signals D0~Dn. The reference voltage generator 307 is used for respectively providing the first reference voltage Vref1 and the second reference voltage Vref2 to head terminals H1 and H2 of loops formed by transmitting the first reference voltage Vref1 and the second reference voltage Vref2 between the data driving ICs 301_1~301_n, wherein end terminals T1 and T2 of the loops formed by transmitting the first reference voltage Vref1 and the second reference voltage Vref2 between the data driving ICs 301_1~130_n are in open circuit.

Accordingly, any position on the loop formed by transmitting the first reference voltage Vref1 between the data driving ICs 301_1~130_n is the first reference voltage Vref1; and any position on the loop formed by transmitting the second reference voltage Vref2 between the data driving ICs 301_1~130_n is the second reference voltage Vref2. The resistances R11~R1n and R21~R2n on the loops formed by transmitting the first reference voltage Vref1 and the second reference voltage Vref2 between the data driving ICs 301_1~301_n are inner resistances of the data driving ICs 301_1~301_n.

The selection units 307_1~307_n are respectively corresponding to the data driving ICs 301_1~301_n. Each of the selection units 307_1~307_n determines the data driving ICs 301_1~301_n to receive the first reference voltage Vref1 or the second reference voltage Vref2 according to the selection signals c11, c12, . . . , c1n and c21, c22, . . . , c2n. For example, the selection unit 307_1 determines the data driving ICs 301_1 to receive the first reference voltage Vref1 or the second reference voltage Vref2 according to the selection signals c11 and c21, and the selection unit 307_2 determines the data driving ICs 301_2 to receive the first reference voltage Vref1 or the second reference voltage Vref2 according to the selection signals c12 and c22, and so on. In the present embodiment, each of the selection units 307_1~307_n is composed of two switches s11, s12, . . . , s1n and s21, s22, . . . , s2n, which would be disposed or manufactured inside or outside the data driving ICs 301_1~301_n. For example, the selection unit 307_1 is composed of switches s11 and s21, and the selection unit 307_2 is composed of switches s12 and s22, and so on, wherein the switch s11 is controlled by the selection signal c11; the switch s12 is controlled by the selection signal c12; and so on, the switch s1n is controlled by the selection signal c1n. Similarly, the switch s21 is controlled by the selection signal c21; the switch s22 is controlled by the selection signal c22, and so on, the switch s2n is controlled by the selection signal c2n.

The detection and control unit 309 is used for detecting the variation of the clock signal CLK and the data signals D0~Dn transmitted between the data driving ICs 301_1~301_n, and outputting the selection signals c11, c12, . . . , c1n and c21, c22, . . . , c2n accordingly to respectively control the selection units 307_1~307_n, so as to determine each of the data driving ICs 301_1~301_n to receive the first reference voltage Vref1 or the second reference voltage Vref2.

In the present embodiment, the detection and control unit 309 detecting the variation of the clock signal CLK and the data signals D0~Dn transmitted between the data driving ICs 301_1~301_n may detect an attenuation status of the clock signal CLK and the data signals D0~Dn transmitted between the data driving ICs 301_1~301_n, but not limited thereto. When the detection and control unit 309 has detected that the attenuation status of the clock signal CLK and the data signals D0~Dn transmitted between the $i^{th}$ data driving IC and the $(i+1)^{th}$ data driving IC is substantially approximate, the detection and control unit 309 enables the $i^{th}$ data driving IC and the $(i+1)^{th}$ data driving IC to receive the same first reference voltage Vref1 or the same second reference voltage Vref2, where i is a positive integer.

Figure 4:
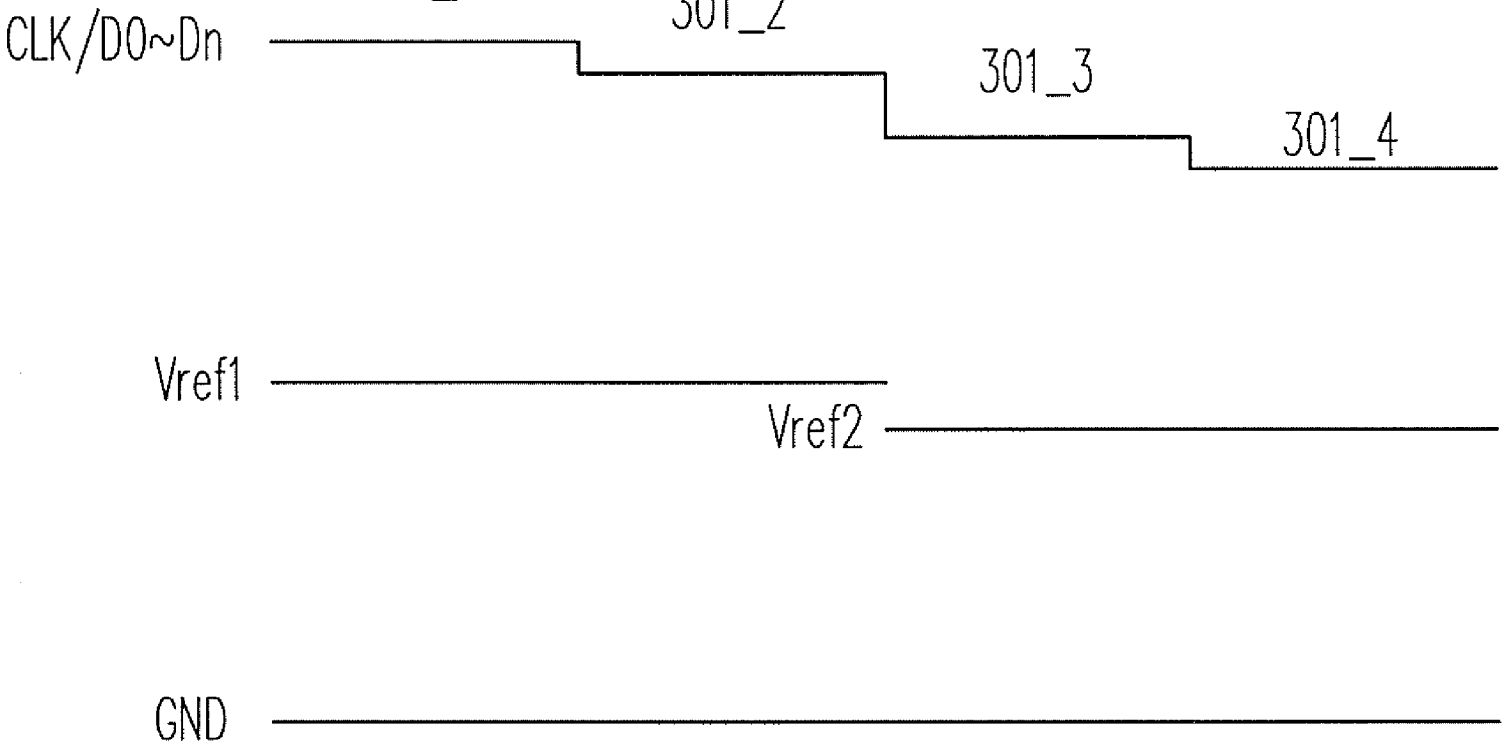
FIG. 4 is a diagram showing a first reference voltage and a second reference voltage received by each of the data driving ICs according to another embodiment of the present invention.

For example, when the detection and control unit 309 has detected that the attenuation status of the clock signal CLK and the data signals D0~Dn transmitted between the $1^{st}$ data driving IC 301_1 and the $2^{nd}$ data driving IC 301_2 is substantially approximate, the detection and control unit 309 would output the selection signals c11, c12, c21 and c22 to respectively control the switches s11 and s12 to turn on at the same time, and the switches s21 and s22 to turn off at the same time. Accordingly, the $1^{st}$ data driving IC 301_1 and the $2^{nd}$ data driving IC 301_2 would receive the same first reference voltage Vref1 (as shown in FIG. 4).

In addition, when the detection and control unit 309 has detected that the attenuation status of the clock signal CLK and the data signals D0~Dn transmitted between the $2^{nd}$ data driving IC 301_2 and the $3^{rd}$ data driving IC 301_3 is substantially great different, the detection and control unit 309 would output the selection signals c12, c13, c22 and c23 to respectively control the switches s12 and s23 to turn on at the same time, and the switches s13 and s22 to turn off at the same time. Accordingly, the $2^{nd}$ data driving IC 301_2 and the $3^{rd}$ data driving IC 301_3 would respectively receive the first reference voltage Vref1 and the second reference voltage Vref2 (as shown in FIG. 4).

Furthermore, when the detection and control unit 309 has detected that the attenuation status of the clock signal CLK and the data signals D0~Dn transmitted between the $3^{rd}$ data driving IC 301_3 and the $4^{th}$ data driving IC 301_4 is substantially approximate, the detection and control unit 309 would output the selection signals c13, c14, c23 and c24 to respectively control the switches s13 and s14 to turn on at the same time, and the switches s23 and s24 to turn off at the same time. Accordingly, the $3^{rd}$ data driving IC 301_3 and the $4^{th}$ data driving IC 301_4 would receive the same second reference voltage Vref2 (as shown in FIG. 4).

In the present embodiment, user can define by self whether the attenuation status of the clock signal CLK and the data signals transmitted between the $i^{th}$ data driving IC and the $(i+1)^{th}$ data driving IC is substantially approximate or not. In other words, user can determine what the attenuation status falling within a range can be seen as approximate, while what the attenuation status exceeding a range can be seen as different by practical design requirement.

From the above, since the detection and control unit 309 would correspondingly determine each of the data driving ICs 301_1~301 _n to receive the first reference voltage Vref1 or the second reference voltage Vref2 according to the variation (i.e. the attenuation status) of the clock signal CLK and the data signals D0~Dn transmitted between the data driving ICs 301_1~301_n, so that each of the data driving ICs would receive the appropriate first reference voltage Vref1 or the appropriate second reference voltage Vref2 correspondingly. Accordingly, the operation frequency of each of the data driving ICs 301_1~301_n would not be restricted by the attenuation of the clock signal CLK and the data signals D0~Dn also.

In summary, the driving apparatus of the LCD submitted by the present invention changes the reference voltage provided to each data driving IC by detecting the variation of the clock signal and the data signals transmitted between the data driving ICs through the control board. Accordingly, each of the data driving ICs will receive an appropriate reference voltage, so that the operation frequency of each of the data driving ICs would not be restricted by the attenuation of the clock signal and the data signals.

It will be apparent to those having ordinary skill in the art that various modifications and variations of the present invention can be made without departing from the scope or spirit of the invention. In view of the foregoing, it is intended that the present invention cover modifications and variations of this invention provided they fall within the scope of the following claims and their equivalents.

What is claimed is:

1. A driving apparatus for use in a liquid crystal display, comprising:

a plurality of data driving integrated circuits, wherein a clock signal, a plurality of data signals, a first reference voltage and a second reference voltage are simultaneously transmitted to the data driving integrated circuits from the $1^{st}$data driving integrated circuit to the last data driving integrated circuit in series, wherein the first reference voltage is different from the second reference voltage; and a control board for providing the clock signal, the data signals, the first reference voltage and the second reference voltage, wherein the control board respectively determines each of the data driving integrated circuits to only receive either the first reference voltage or the second reference voltage in operation according to a variation of the clock signal and the data signals transmitted between the data driving integrated circuits, such that an $i^{th}$ data driving integrated circuit and an $(i+1)^{th}$ data driving integrated circuit of the plurality of data driving integrated circuits respectively receive the first reference voltage and the second reference voltage simultaneously in operation when the variation of the clock signal and the data signals transmitted between the data driving integrated circuits exceeds a predetermined value, where i is a positive integer, wherein the $i^{th}$ data driving integrated circuit and the $(i+1)^{th}$ data driving integrated circuit receive the same first reference voltage or the same second reference voltage in operation when the variation does not exceed the predetermined value.

2. The driving apparatus according to claim 1, wherein the control board comprises:

a timing controller for generating the clock signal and the data signals;

a reference voltage generator for respectively providing the first reference voltage and the second reference voltage to head terminals of loops formed by transmitting the first reference voltage and the second reference voltage between the data driving integrated circuits, wherein end terminals of the loops formed by transmitting the first reference voltage and the second reference voltage between the data driving integrated circuits are in open circuit, such that any position on the loop formed by transmitting the first reference voltage between the data driving integrated circuits is the first reference voltage without having voltage drop, and any position on the loop formed by transmitting the second reference voltage between the data driving integrated circuits is the second reference voltage without having voltage drop;

a plurality of selection units, respectively corresponding to the data driving integrated circuits, wherein each of the selection units determines the data driving integrated circuits to receive either the first reference voltage or the second reference voltage in operation according to selection signals; and a detection and control unit, for detecting the variation and outputting the selection signals accordingly to respectively control the selection units, so as to respectively determine each of the data driving integrated circuits to receive either the first reference voltage or the second reference voltage in operation according to the variation.

3. The driving apparatus according to claim 2, wherein the variation is an attenuation status of the clock signal and the data signals transmitted between the data driving integrated circuits.

4. The driving apparatus according to claim 3, wherein when the detection and control unit has detected that the attenuation status of the clock signal and the data signals transmitted between the $i^{th}$ data driving integrated circuit and the $(i+1)^{th}$ data driving integrated circuit is substantially approximate, the detection and control unit enables the $i^{th}$ data driving integrated circuit and the $(i+1)^{th}$ data driving integrated circuit to receive the same first reference voltage or the same second reference voltage in operation.

5. The driving apparatus according to claim 4, wherein the selection units respectively dispose inside the data driving integrated circuits.

6. The driving apparatus according to claim 4, wherein the selection units respectively dispose outside the data driving integrated circuits.

7. A driving apparatus for use in a liquid crystal display, comprising:

a plurality of data driving integrated circuits, wherein a clock signal, a plurality of data signals, a first reference voltage and a second reference voltage are simultaneously transmitted from the $1^{st}$ data driving integrated circuit to the last data driving integrated circuit in series, wherein the first reference voltage is different from the second reference voltage; and a control board for providing the clock signal, the data signals, the first reference voltage and the second reference voltage, wherein the control board respectively determines each of the data driving integrated circuits to receive either the first reference voltage or the second reference voltage in operation according to whether an attenuation status of the clock signal and the data signals transmitted between the data driving integrated circuits substantially has a great difference, such that an $i^{th}$ data driving integrated circuit and an $(i+1)^{th}$ data driving integrated circuit of the plurality of data driving integrated circuits respectively receive the first reference voltage and the second reference voltage in operation at a same time when the attenuation status of the clock signal and the data signals transmitted between the data driving integrated circuits substantially has the great difference, where i is a positive integer.

8. The driving apparatus according to claim 7, wherein the control board comprises:

a timing controller for generating the clock signal and the data signals;

a reference voltage generator for respectively providing the first reference voltage and the second reference voltage to head terminals of loops formed by transmitting the first reference voltage and the second reference voltage between the data driving integrated circuits, wherein end terminals of the loops formed by transmitting the first reference voltage and the second reference voltage between the data driving integrated circuits are in open circuit, such that any position on the loop formed by transmitting the first reference voltage between the data driving integrated circuits is the first reference voltage without having voltage drop, and any position on the loop formed by transmitting the second reference voltage between the data driving integrated circuits is the second reference voltage without having voltage drop;

a plurality of selection units, respectively corresponding to the data driving integrated circuits, wherein each of the selection units determines the data driving integrated circuits to receive either the first reference voltage or the second reference voltage in operation according to selection signals; and a detection and control unit, for detecting the attenuation status and outputting the selection signals accordingly to respectively control the selection units, so as to respectively determine each of the data driving integrated circuits to receive either the first reference voltage or the second reference voltage in operation according to the attenuation status.

9. The driving apparatus according to claim 8, wherein when the detection and control unit has detected that the attenuation status of the clock signal and the data signals transmitted between the $i^{th}$ data driving integrated circuit and the $(i+1)^{th}$ data driving integrated circuit is substantially approximate and does not have the great difference, the detection and control unit enables the $i^{th}$ data driving integrated circuit and the $(i+1)^{th}$ data driving integrated circuit to receive the same first reference voltage or the same second reference voltage in operation.

10. The driving apparatus according to claim 9, wherein the selection units respectively dispose inside or outside the data driving integrated circuits.

11. A driving apparatus for use in a liquid crystal display, comprising:

a plurality of data driving integrated circuits, wherein a clock signal, a plurality of data signals, a first reference voltage and a second reference voltage are simultaneously transmitted from the $1^{st}$ data driving integrated circuit to the last data driving integrated circuit in series, wherein the first reference voltage is different from the second reference voltage; and a control board for providing the clock signal, the data signals, the first reference voltage and the second reference voltage, wherein the control board determines an $i^{th}$ data driving integrated circuit and an $(i+1)^{th}$ data driving integrated circuit of the plurality of data driving integrated circuits to receive either the first reference voltage or the second reference voltage in operation according to whether a substantial great difference caused by a transmitting attenuation is formed between the clock signal and the data signals received by the $i^{th}$ data driving integrated circuit and the $(i+1)^{th}$ data driving integrated circuit, such that the $i^{th}$ data driving integrated circuit and the $(i+1)^{th}$ data driving integrated circuit respectively receive the first reference voltage and the second reference voltage in operation at a same time when the substantial great difference caused by the transmitting attenuation is formed between the clock signal and the data signals received by the $i^{th}$ data driving integrated circuit and the $(i+1)^{th}$ data driving integrated circuit, where i is a positive integer.

12. The driving apparatus according to claim 11, wherein the control board comprises:

a timing controller for generating the clock signal and the data signals;

a reference voltage generator for respectively providing the first reference voltage and the second reference voltage to head terminals of loops formed by transmitting the first reference voltage and the second reference voltage between the data driving integrated circuits, wherein end terminals of the loops formed by transmitting the first reference voltage and the second reference voltage between the data driving integrated circuits are in open circuit, such that any position on the loop formed by transmitting the first reference voltage between the data driving integrated circuits is the first reference voltage without having voltage drop, and any position on the loop formed by transmitting the second reference voltage between the data driving integrated circuits is the second reference voltage without having voltage drop;

a plurality of selection units, respectively corresponding to the data driving integrated circuits, wherein each of the selection units determines the data driving integrated circuits to receive either the first reference voltage or the second reference voltage in operation according to selection signals; and a detection and control unit, for detecting the transmitting attenuation and outputting the selection signals accordingly to respectively control the selection units, so as to respectively determine each of the data driving integrated circuits to receive either the first reference voltage or the second reference voltage in operation according to the transmitting attenuation.

13. The driving apparatus according to claim 12, wherein when the detection and control unit has detected that the substantial great difference caused by the transmitting attenuation is not formed between the clock signal and the data signals received by the $i^{th}$ data driving integrated circuit and the $(i+1)^{th}$ data driving integrated circuit, it represents that the clock signal and the data signals received by the $i^{th}$ data driving integrated circuit and the $(i+1)^{th}$ data driving integrated circuit are substantially approximate, such that the detection and control unit enables the $i^{th}$ data driving integrated circuit and the $(i+1)^{th}$ data driving integrated circuit to receive the same first reference voltage or the same second reference voltage in operation.

14. The driving apparatus according to claim 13, wherein the selection units respectively dispose inside or outside the data driving integrated circuits.

* * * * *